US005295852A

United States Patent [19]

Renn et al.

[11] Patent Number: 5,295,852

[45] Date of Patent: Mar. 22, 1994

[54] COPLANAR COMPUTER DOCKING SYSTEM

[75] Inventors: Robert M. Renn, Pfafftown; Keith L. Volz, Jamestown; Robert D. Irlbeck, Greensboro; Frederick R. Deak, Kernersville; David C. Johnson; Warren A. Bates, both of Winston-Salem, all of N.C.

[73] Assignee: The Whitaker Corporation, Wilmington, Del.

[21] Appl. No.: 89,867

[22] Filed: Jul. 12, 1993

[51] Int. Cl.[5] ..... H01R 13/62

[52] U.S. Cl. ..... 439/328; 439/67; 439/631; 439/493

[58] Field of Search ..... 439/50, 62, 65, 66, 439/67, 325, 327, 328, 329, 330, 493, 631, 632, 492

[56] References Cited

U.S. PATENT DOCUMENTS 4,111,510 9/1978 Zurchev ..... 439/67
4,969,824 11/1990 Casciotti ..... 439/67
5,041,003 8/1991 Smith et al. ..... 439/329
5,145,381 9/1992 Volz ..... 439/62
5,161,981 1/1992 Deak et al. ..... 439/67

*Primary Examiner*—Larry I. Schwartz
*Assistant Examiner*—Hien D. Vu
*Attorney, Agent, or Firm*—William B. Noll

[57] ABSTRACT

The invention hereof relates to electronic apparatus, such as a computer docking connector. More particularly, the invention relates to a docking connector for edge mounting to a "mother" board, where a "daughter" board, memory card, or similar device is inserted into said connector to electrically interconnect the mother board to the inserted device. The apparatus comprises a pair of spring biased, hermaphroditic, resilient housing members, which when assembled define an elongated slot planarly aligned with an edge of the mother board. Opposed camming surfaces are provided with the slot to operatively spread the housing members upon insertion of the electronic device int the slot. Finally a flexible film member containing electrical circuitry thereon is mounted within the housing members for electrically interconnecting corresponding circuitry on the mother board and the electronic device.

5 Claims, 9 Drawing Sheets

26
64
14
70
20
46

26
64
14
70
20
46

26
64
70
14
20
46

Fig. 12
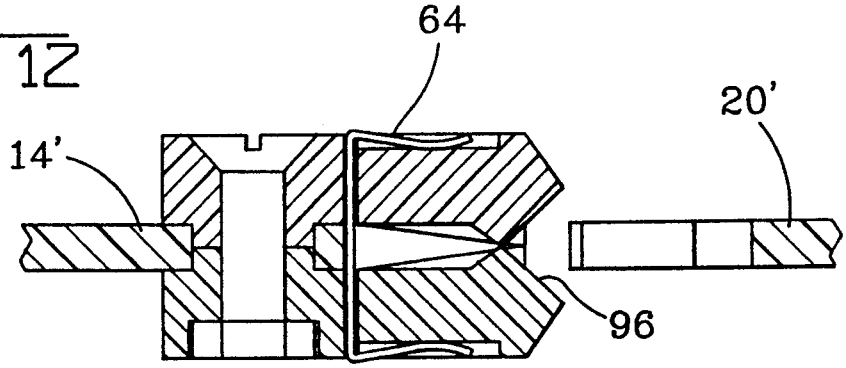
Fig. 13
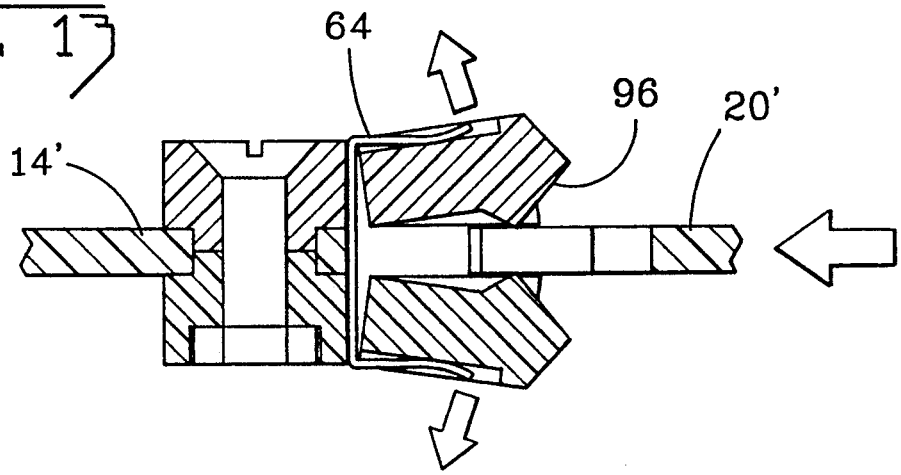
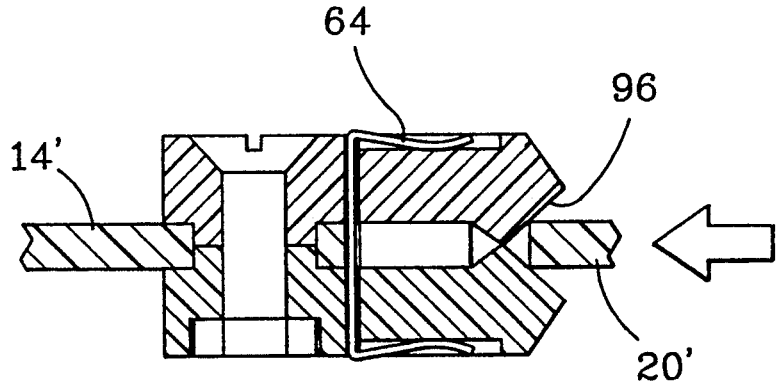
Fig. 14

COPLANAR COMPUTER DOCKING SYSTEM

BACKGROUND OF THE INVENTION

This invention is directed to electronic apparatus, such as a computer docking connector. More precisely, the invention hereof relates to a docking connector for edge mounting to a "mother" board, where a "daughter" board, memory card, or similar device is inserted into said connector to electrically interconnect the mother board to the inserted device to provide a PCMCIA type interface connection.

The assignee of this invention has been actively involved in developing computer docking systems, as exemplified by U.S. patent application Ser. No. 07/955,474 and Ser. No. 07/995,615, both of which were filed Dec. 22, 1992, and Ser. No. 08/056,522, filed Apr. 28, 1993. In the '474 application, the docking system includes a docking station having an electrical member provided with at least one circuit element thereon, and a device for slidably insertion into the docking station which has at least one circuit element thereon. A connector housing within the docking station has a flexible electrical connector providing a circuit interface between the circuit elements on the electrical member and the device, respectively. The device has at least one camming protrusion formed thereon, and the docking station has a camming surface engaging the camming protrusion as the device is slidably inserted into the docking station. Because of the camming action, the device is deflected relative to the connector housing in a direction which is substantially transverse to the direction in which the device is slidably inserted into the docking station, thereby assuring a substantially zero insertion force for the circuit interface, and thereby preserving the structural integrity and hence the reliability of the circuit interface within the docking station. Upon full insertion of the device, the camming protrusion is received in a recess means in the docking station.

In the docking system disclosed in the '615 application, a computer is provided with a guide housing within which a device is slidably inserted. In one embodiment, the device carries a pair of manually-releasable spring-loaded latches pivotally mounted thereon about respective axes which are substantially perpendicular to the direction in which the device is slidably inserted into the guide housing for engagement with respective hooks on the computer. In another embodiment, the latches are pivotably mounted on the guide housing about respective axes which are substantially parallel to the direction in which the device is slidably inserted into the guide housing. The guide housing includes a fixed bottom portion on which the latches are pivotably mounted, and further includes a spring-loaded movable top portion receiving the device and ultimately nested telescopically within the fixed bottom portion. In each embodiment, a substantially zero insertion force ("ZIF") is achieved between at least one flexible electrical connector and a circuit pad as the device is inserted into the guide housing.

The latest docking system, as disclosed in the 15549 application, is a system which slidably receives a device to make, break or tap functions, respectively, in a circuit interface. The circuit interface includes a pair of connector housings provided with flexible, i.e. compressible, electrical connectors respectively. A camming means separates the connector housings as the device is slidably inserted into the docking station, thereby assuring a substantially zero insertion force on the circuit interface. Preferably, the circuit interface is between the flexible electrical connectors, a printed circuit board, and a flexible etched circuit. The flexible etched circuit is provided with a stiffener resiliently biased by springs.

The present invention represents a further approach in providing a coplanar docking system that offers low cost, is highly reliable, and offers a high cycle life, while satisfying the requirements of a PCMCIA type interface. As will be apparent in the description which follows, such approach incorporates the use of a pair of spring biased, hermaphroditic, resilient housing members, into which a flexible film member is placed to provide the necessary electrical interconnection. A preferred flexible film member may comprise a plurality of closely-spaced conductive elements or traces photographically etched or otherwise formed on a flexible film, a product sold under the trademark, "AMPLI-FLEX", by AMP Incorporated of Harrisburg, Pa.

SUMMARY OF THE INVENTION

This invention relates to electronic apparatus, such as a coplanar computer docking connector. A preferred embodiment is a connector for electrically connecting a "daughter" board, memory card, or similar device, to a "mother" board. In such preferred embodiment, the apparatus, intended for card edge mounting an electronic device to a mother board, for example, comprises a pair of spring biased, hermaphroditic, resilient housing members, which when assembled define an elongated slot planarly aligned with an edge of the mother board. Opposed camming surfaces are provided within the slot to operatively spread the housing members upon insertion of the electronic device into the slot. Finally, a flexible film member, containing electrical circuitry thereon, is mounted within the housing members for electrically interconnecting corresponding circuitry on the mother board and the electronic device.

BRIEF DESCRIPTION OF DRAWINGS

FIG. 3 is an enlarged sectional view taken along line 3—3 of FIG. 1.

FIGS. 12–14 are sequential sectional views, taken along line 12—12 of FIG. 10, comparable to FIGS. 7 to 9, for the alternate embodiment of FIG. 10.

DETAILED DESCRIPTION OF PREFERRED EMBODIMENTS

This invention is directed to an electronic apparatus, such as a coplanar docking connector for edge mounting a "daughter" board to a "mother" board, by way of example. The unique features hereof will become more apparent in the description which follows, particularly when read in conjunction with the accompanying drawings.

Figure 1:
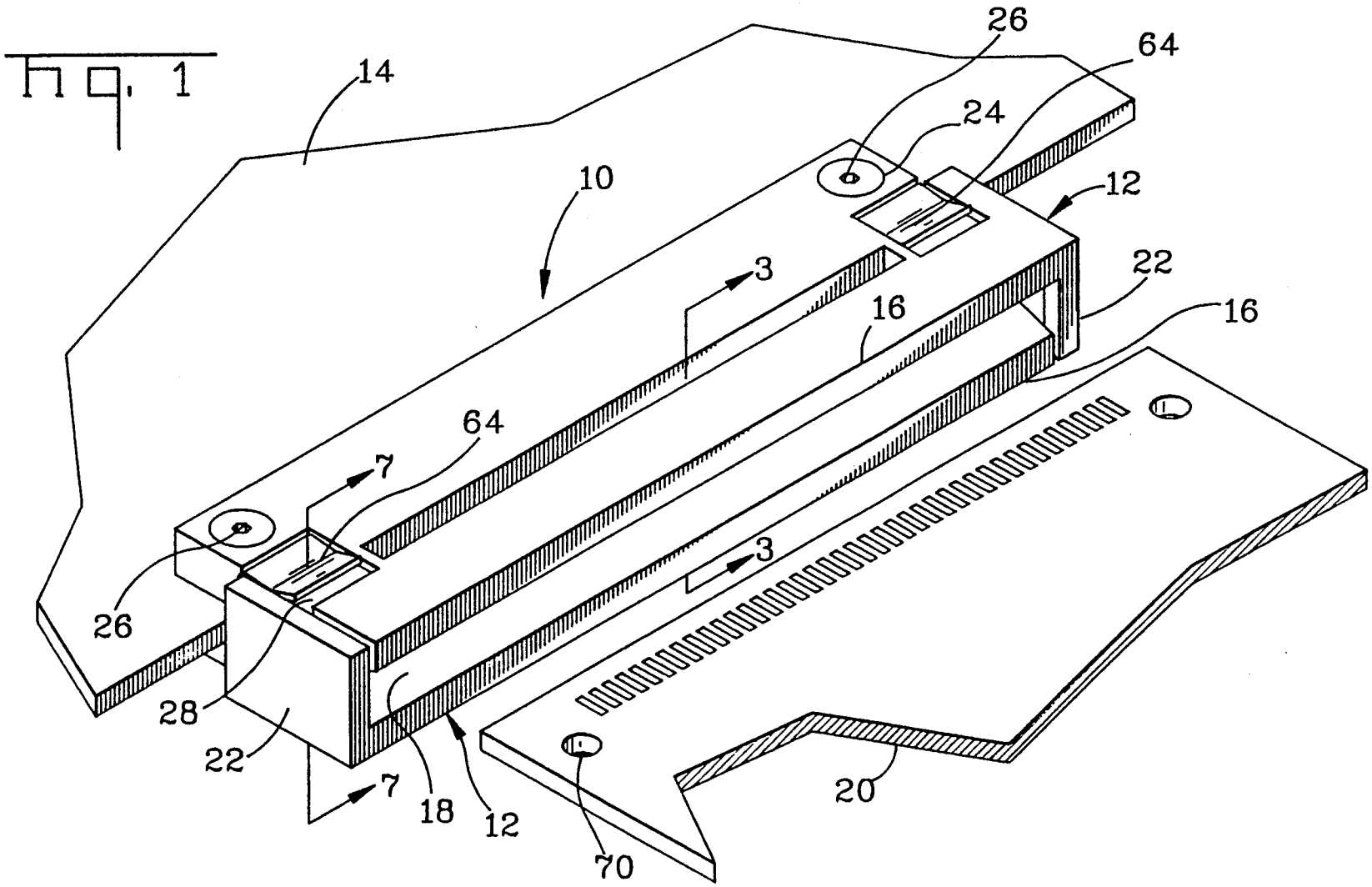
FIG. 1 is a perspective view of a preferred embodiment of a coplanar docking connector showing the relationship of the connector for interconnection, two boards, such as a mother board and a daughter board, according to this invention.
Figure 2:
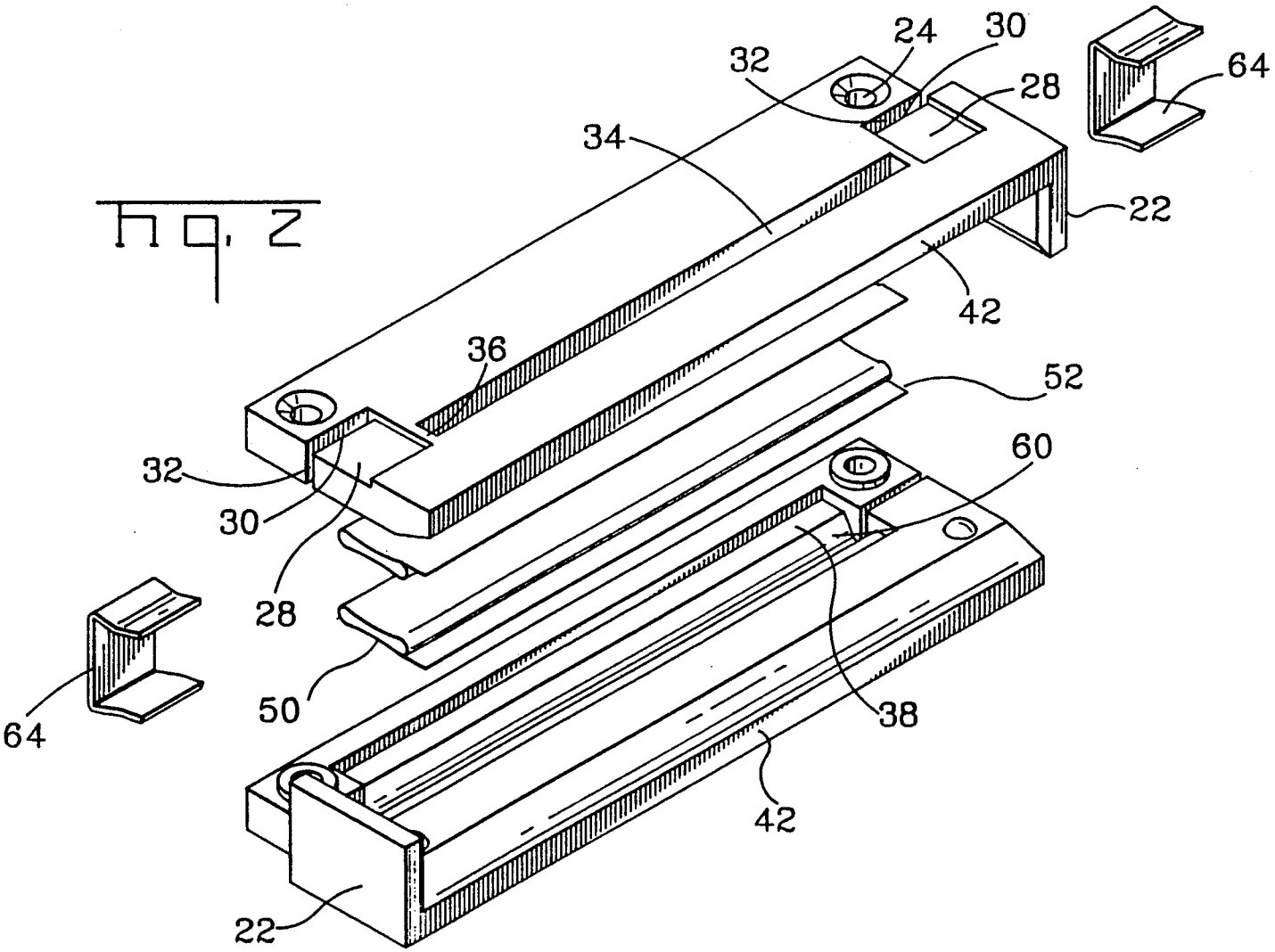
FIG. 2 is an exploded perspective view of the connector of FIG. 1.
Figure 7:
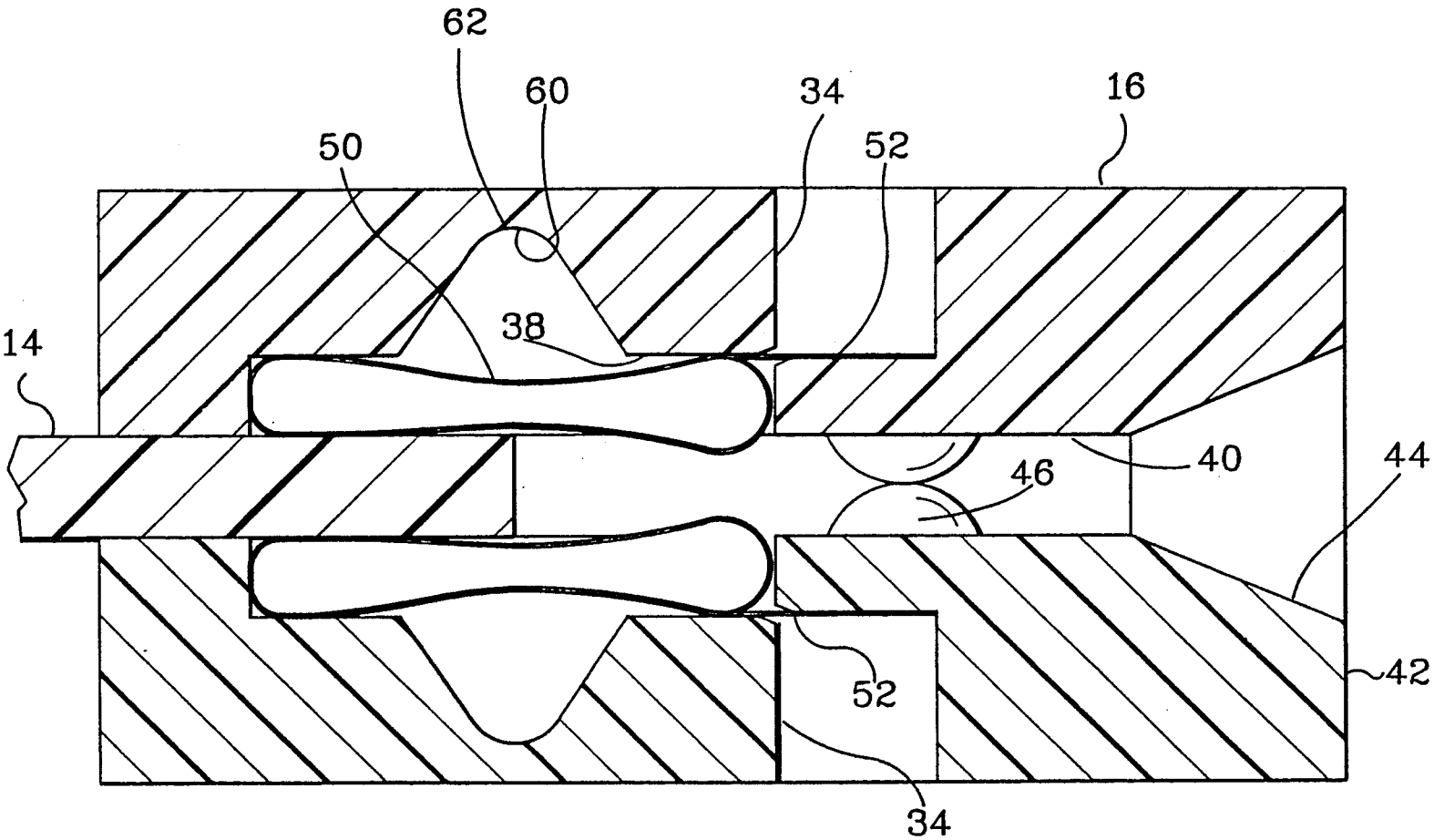
FIGS. 7 to 9 are sectional views taken generally along the line 7—7 of FIG. 1, illustrating the connector loading sequence, particularly the force member in operation as the board is inserted into the connector.
Figure 4:
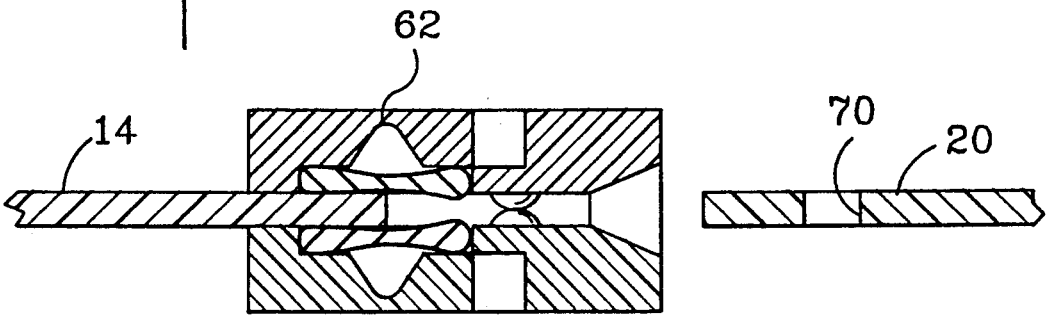
FIGS. 4–6 are sectional views comparable to FIG. 3, illustrating the sequence of inserting a daughter board into the connector into abutting relationship to a mother board, for example.
Figure 5:
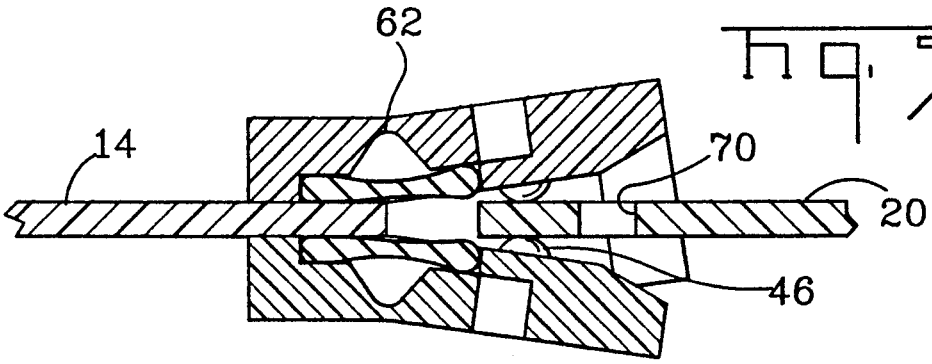
Figure 6:
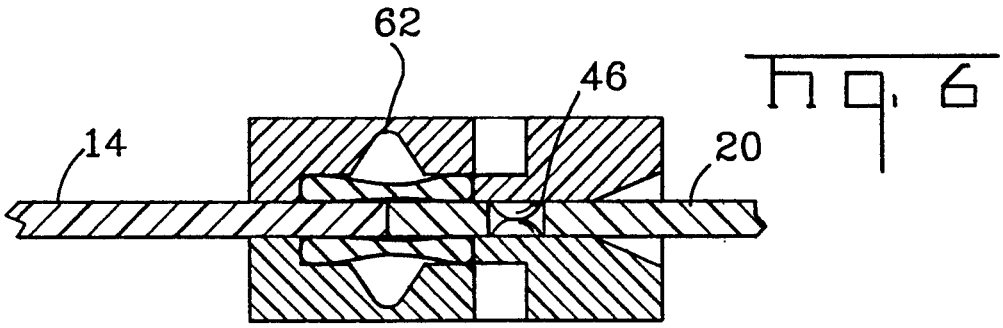
Figure 7:
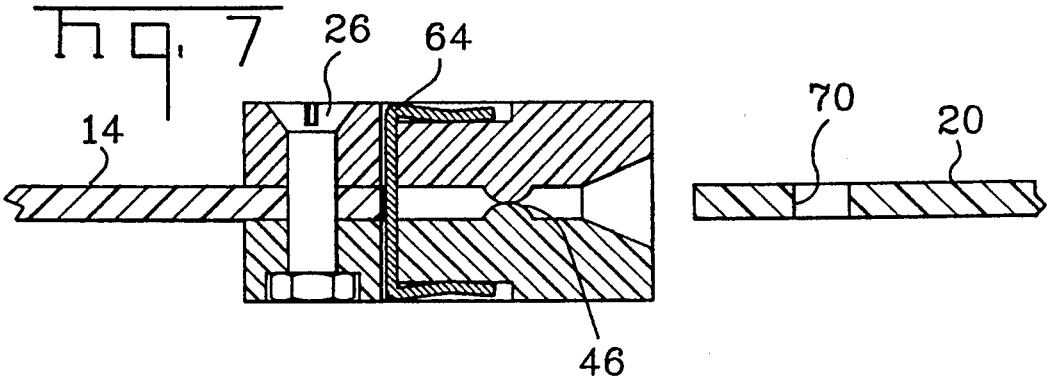
Figure 8:
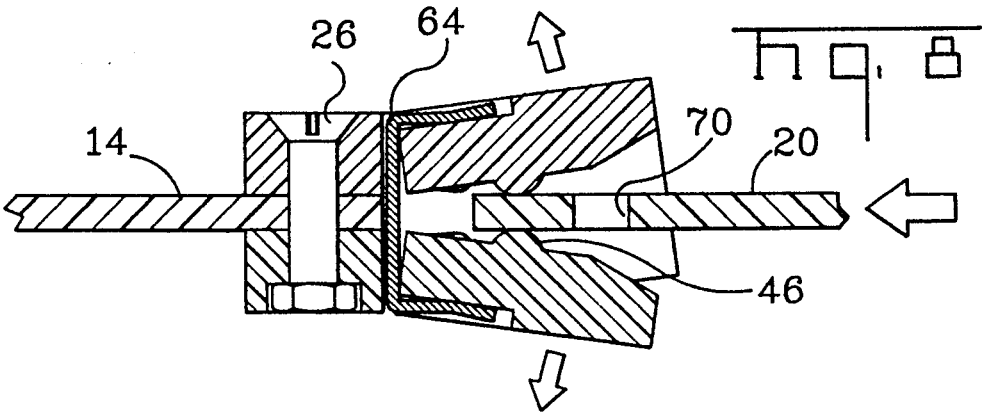
Figure 9:
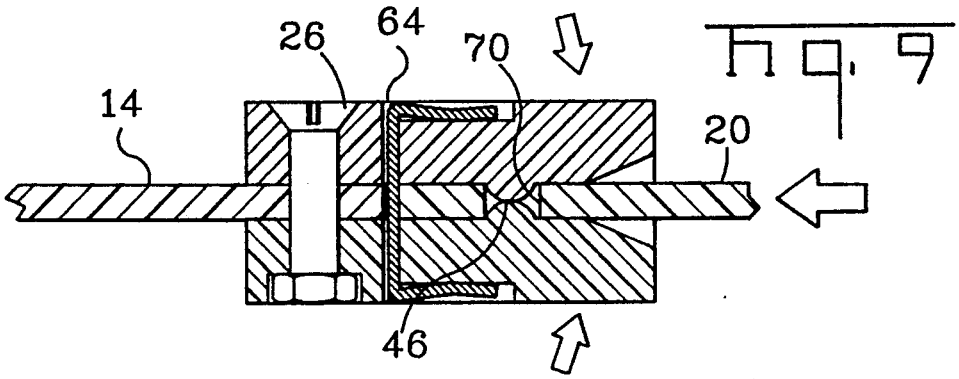

For convenience, the further description will relate primarily to the connector for electrically interconnecting a daughter board to a mother board. However, it should be recognized that other planar electronic devices may be used, where they share in common the features of being of a planar construction having electrical circuitry thereon, in the form of traces or pads. With this understanding, reference may be made to FIGS. 1 and 2, illustrating the connector components of a preferred connector of this invention. The connector 10 hereof comprises a pair of spring biased, hermaphroditic, resilient housing members 12, to be mounted to a mother board 14, for example. When such housing members are assembled, as illustrated in FIG. 1, the spaced apart walls 16 define a slot 18 therebetween for receiving daughter board 20.

Each housing member, as best seen in FIG. 2, comprises an L-shaped members defined by housing wall 16 and side wall 22, upstanding therefrom. The housing wall 16 includes mounting holes 24 to receive suitable fasteners 26 for mounting the connector 10 to the mother board 14. Additionally, the housing wall 16 includes a spring clip receiving recess 28, where one edge 30 thereof is defined by a slot 32. Between said recesses 28, the housing wall includes a longitudinal slot 34 to yield a narrow or thin wall portion 36 between the slot 34 and recess 28. As best seen in FIG. 3, the wall portion 36 is further reduced in section to a relatively thin web. Finally, the slot 34 opens into a flexible film receiving recess 38, see FIG. 3, as hereinafter further explained.

Along the inner surface 40 of housing wall 16, the slot defining end 42 is provided with a tapered portion 44 to facilitate insertion of the daughter board 20 into slot 18. Additionally, the inner surface 40, adjacent the tapered portion 44, is provided with a pair of camming bumps 46, the function of which will become apparent hereinafter.

Before engaging the housing members 12 to form the connector structure of FIG. 1, a flexible film 50, having electrical circuitry thereon, in the form of a continuous loop with a targential tail 52, is placed within the recess 38. The tail 52, through slot 54, seats or rides freely in the bottom of recess 34 to allow the film 50 to shift laterally and prevent damage to the film as the housings flex, the manner of which will be described hereinafter.

The film recess 38 is characterized by an extended chamber portion 60 throughout the connector wall to reveal a thin or narrow web 62, which as explained hereinafter, will allow flexing of the assembled connector between the portion thereof secured to the mother board 14, and the connector portion receiving the daughter board 20.

Returning now to FIGS. 1 and 2, and to the assembly of the connector 10, a pair of C-shaped metal clips 64 are provided as the holding force for the respective housing members 12. As shown in FIG. 2, after placing the films 50 into the recesses 38, and the one housing member 12 inverted, then brought into engagement with the second housing member 12. The engaged housing members 12 are then secured to the mother board 14 by fasteners 26. With the respective housing members 12 essentially mounted in cantilever fashion with respect to the mother board 14, a pair of metal clips 64 are inserted into the slots 32, adjacent edges 30, to seat within the recesses 28, with the opening of the clips 64 directed toward the daughter board receiving slot 18. By virtue of the spring action of the metal clips 64, a clamping force is applied to the assembly housing members 12.

FIGS. 4 to 6 and 7 to 9 are sequential sectional views of the connector loading operation. In the first sequence, it will be seen that as the daughter board 20 is inserted into the housing slot 18 into contact with camming bumps 46, the housing walls 16 are caused to yield or spread apart to allow further insertion of the daughter board 20 into abutting contact with the mother board 14. As the housing walls 16 yield it will be observed that the thin walled web 62 acts as a flexible hinge. Once the daughter board is fully inserted into the connector, where the holes 70 thereof are in alignment with the camming bumps 46, the housing walls 16 resile to a closed position under the action of the clips 64, see FIGS. 7 to 9.

Figure 10:
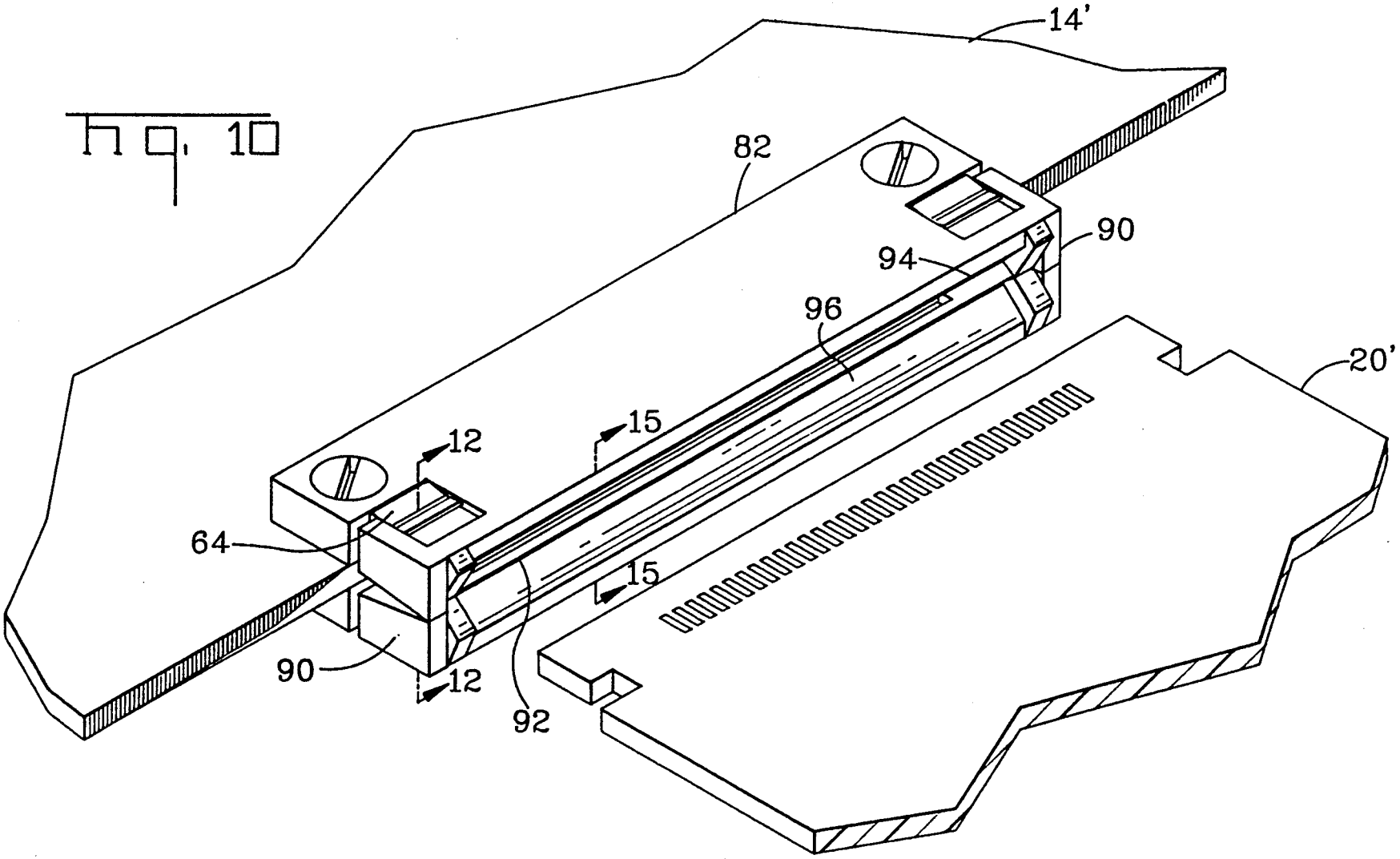
FIG. 10 is a perspective similar to FIG. 1, showing an alternate embodiment.
Figure 11:
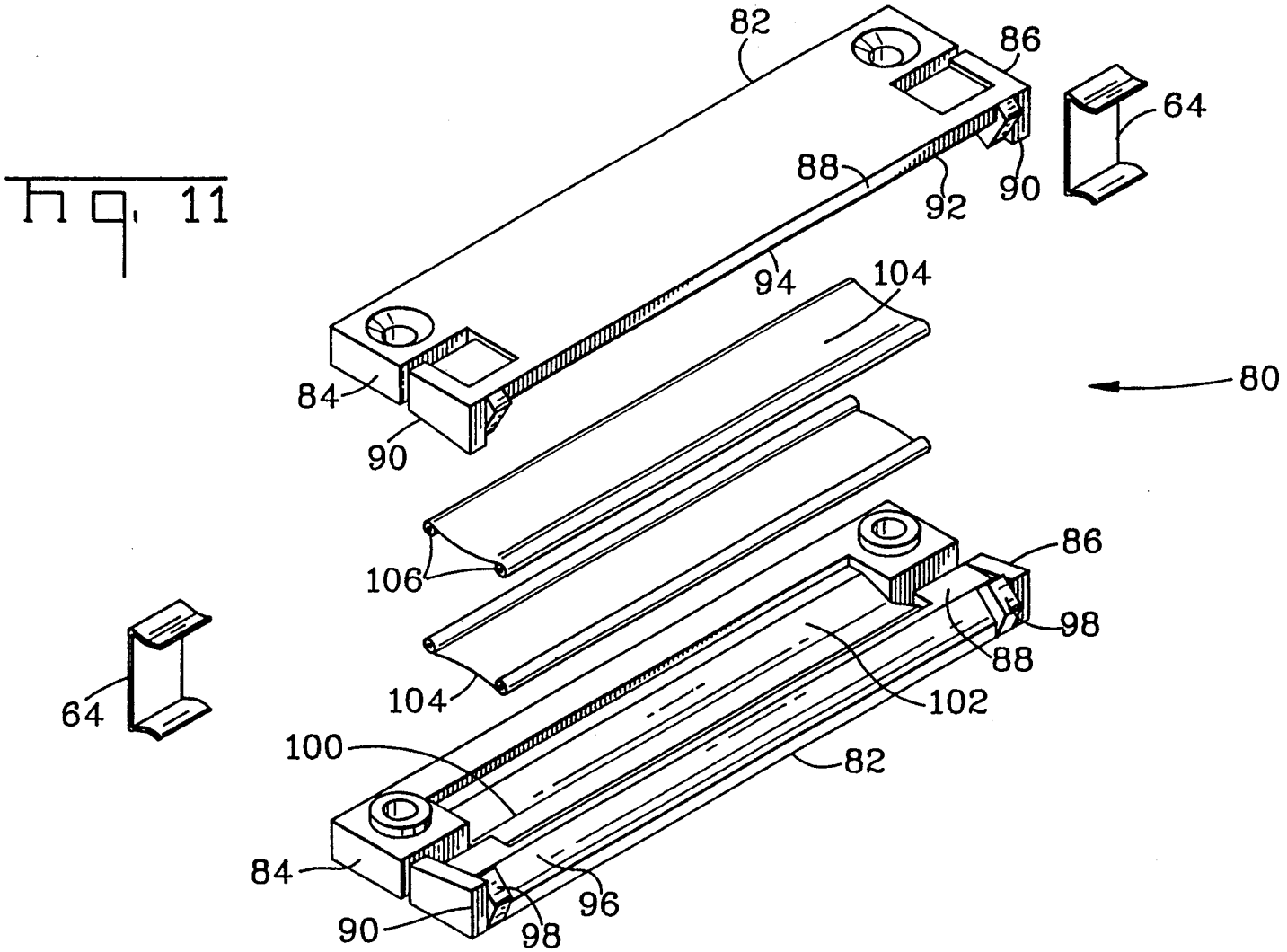
FIG. 11 is an exploded perspective view of the connector of FIG. 10.
Figure 15:
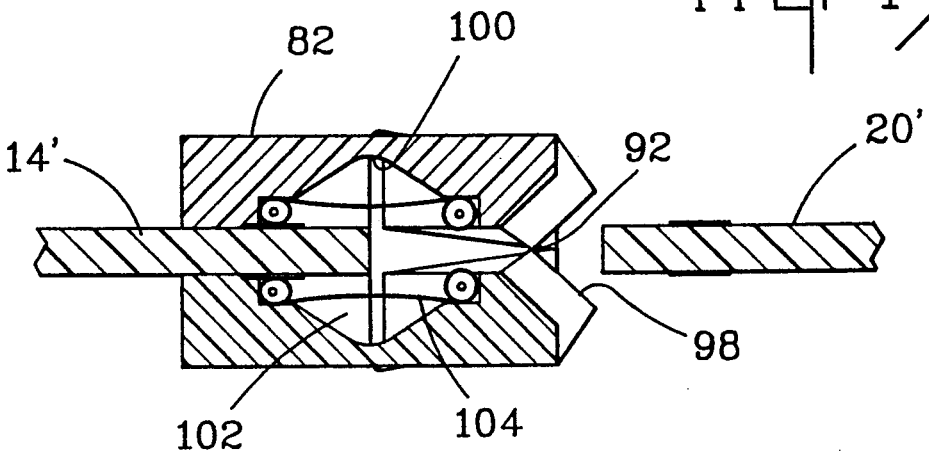
FIGS. 15-17 are sequential sectorial views, taken along line 15—15 of FIGS. 10, comparable to FIGS. 4 to 6, for the alternate embodiment of FIG. 10.

FIGS. 10 and 11 represent an alternate embodiment to that illustrated in the previous Figures. While the operation of loading the connector is essentially the same, there are some structural or design changes. Specifically, the connector 80 utilizes a pair of modified housing members 82. Each housing member includes a rear mounting portion 84, to be secured to the mother board 14', and a flexible forward portion 86. The forward portion is further characterized by a wall portion 88 with a pair of side walls 90 projecting normal thereto. In the assembled condition, the respective wall portions 88 and side walls 90 define a daughter board 20' receiving slot 92. The mouth 94 of slot 92 is tapered 96 to facilitate loading of the connector, and further includes camming ramps 98 to effect spreading of the wall portions 88 when contacted by the daughter board 20'. Like the former embodiment, a thin walled section 100 is provided in the film receiving recess 102 to allow flexing of the connector under the action of the daughter board 20' being loaded therein.

Figure 16:
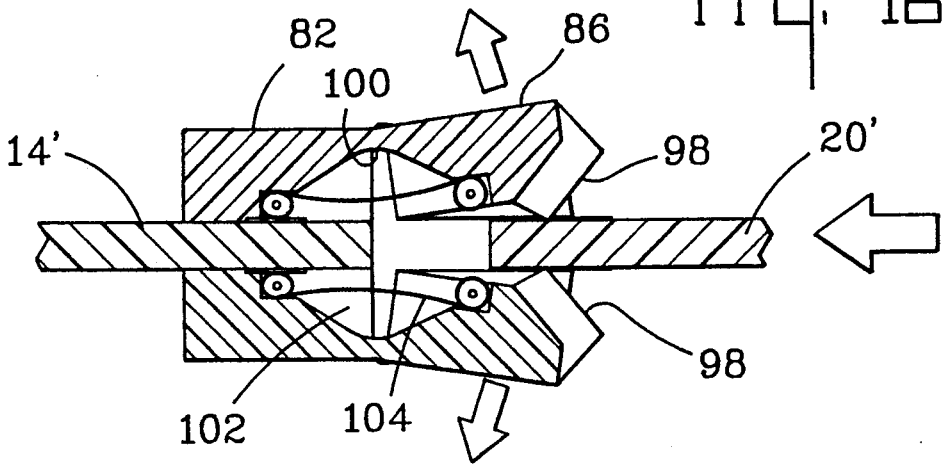
Figure 17:
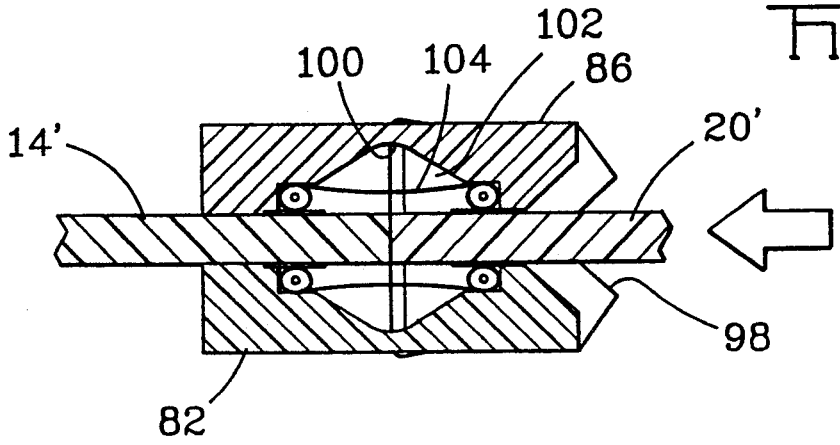

The flexible film 104 configuration has also been modified. Specifically, the film 104 is formed into a scroll shape, i.e. wrapped about a pair of elongated elastomeric members 106, where the circuitry on the film is positioned to electrically interconnect respective circuit traces between the mother board 14' and daughter board 20'. From the loading sequences of FIGS. 12 to 14 and 15 to 17, it will be seen that the functional operation of the two embodiments are essentially the same. However, it will be noted in FIG. 16, that as the daughter board 20' spreads the housing members 82, the film 104 is lifted out of contact with the daughter board 20'. This protects the delicate circuitry of the film. When the forward housing portions 86 finally resile as shown in FIG. 17, only then is the film 104 brought into engagement with the respective circuitry traces on the daughter board 20'.

We claim:

1. Electronic apparatus for card edge mounting an electronic device, to a mother board, said apparatus comprising a pair of spring biased, hermaphroditic, resilient housing members, which when assembled define an elongated slot which receives an edge of said mother board therein, opposed camming surfaces within said slot to operatively spread said housing members upon insertion of said electronic device into said slot, and a flexible film member containing electrical circuitry thereon mounted within said housing members for electrically interconnecting corresponding circuitry on said mother board and said electronic device, wherein said electronic device includes a camming relief notch for receiving said camming surfaces when said electronic device is fully inserted into said slot.

2. The electronic apparatus according to claim 1, wherein said housing members are provided with a pair of C-shaped metal clips formed of a spring metal to facilitate opening and closing of said slot.

3. The electronic apparatus according to claim 1, wherein said flexible film member is in the form of a continuous loop.

4. The electronic apparatus according to claim 1, wherein said flexible film member is in the form of a scroll.

5. The electronic apparatus according to claim 1, wherein said housing members include a thin transverse wall portion to allow flexing of said housing members.

* * * * *